US006565400B1

(12) United States Patent
Lee et al.

(10) Patent No.: US 6,565,400 B1
(45) Date of Patent: May 20, 2003

(54) FRIT PROTECTION IN SEALING PROCESS FOR FLAT PANEL DISPLAYS

(75) Inventors: Jueng-Gil Lee, Cupertino, CA (US); Paul N. Ludwig, Livermore, CA (US); Melissa Skocypec, Gilbert, AZ (US)

(73) Assignee: Candescent Technologies Corporation, San Jose, CA (US)

( * ) Notice: Subject to any disclaimer, the term of this patent is extended or adjusted under 35 U.S.C. 154(b) by 0 days.

(21) Appl. No.: 09/893,089

(22) Filed: Jun. 26, 2001

(51) Int. Cl.[7] ..... H01J 9/26; H01J 9/32

(52) U.S. Cl. ..... 445/25; 445/24; 313/495; 313/497

(58) Field of Search ..... 445/24, 25; 313/495, 313/496, 497

(56) References Cited

U.S. PATENT DOCUMENTS 6,019,657 A * 2/2000 Chakvorty et al. ..... 445/24

6,113,450 A * 9/2000 Narayanan et al. ..... 445/25

* cited by examiner

*Primary Examiner*—Kenneth J. Ramsey
*Assistant Examiner*—Mariceli Santiago
(74) *Attorney, Agent, or Firm*—Wagner, Murabito & Hao LLP

(57) ABSTRACT

A method for attaching a faceplate and a backplate of a field emission display device. Specifically, one embodiment of the present invention discloses a method for protecting a silicon nitride passivation layer from reacting with a glass frit sealing material that contains lead oxide during an oven sealing or laser sealing process. The passivation layer protects row and column electrodes in the display device. A barrier material fully encapsulates the silicon nitride passivation layer. In one embodiment, silicon dioxide is the barrier material. In another embodiment, spin-on-glass is the barrier material. In still another embodiment, cermet is the barrier material.

22 Claims, 6 Drawing Sheets

FRIT PROTECTION IN SEALING PROCESS FOR FLAT PANEL DISPLAYS

BACKGROUND OF THE INVENTION

1. Field of the Invention

The present invention relates to the field of flat panel displays. More specifically, the present invention relates to a flat panel display and methods for forming a flat panel display having a frit seal that is protected from reaction with a passivation layer.

2. Related Art

A Cathode Ray Tube (CRT) display generally provides the best brightness, highest contrast, best color quality and largest viewing angle of prior art displays. CRT displays typically use a layer of phosphor that is deposited on a thin glass faceplate. These CRTs generate a picture by using one to three electron beams that generate electrons that are scanned across the phosphor in a raster pattern. The phosphor converts the electron energy into visible light so as to form the desired picture. However, prior art CRT displays are large and bulky due to the large vacuum tubes that enclose the cathode and extend from the cathode to the faceplate of the display. Therefore, other types of display technologies such as active matrix liquid crystal display, plasma display and electroluminescent display technologies have been used in the past to form thin displays.

Recently, a thin flat panel display has been developed that uses the same process for generating pictures as is used in CRT devices. These thin flat panel displays use a backplate including a matrix structure of rows and columns of electrodes. One such flat panel display is described in U.S. Pat. No. 5,541,473 titled GRID ADDRESSED FIELD EMISSION CATHODE that is incorporated herein by reference as background material. Typically, the backplate is formed by depositing a cathode structure (electron emitting) on a glass plate. The cathode structure includes emitters that generate electrons. The backplate typically has an active area within which the cathode structure is deposited. Typically, the active area does not cover the entire surface of the glass plate, leaving a thin strip that extends around the glass plate. Electrically conductive traces extend through the thin strip to allow for connectivity to the active area.

Prior Art FIG. 1 illustrates a flat panel display device 100. A backplate 105 is shown with an active area 110. Glass frit bars for sealing the backplate 105 to a faceplate (not shown) are deposited within the thin strip area 160 that does not contain the active area 110. This thin strip area is also called the pad bond region 160. The glass frit bars can be partitioned into glass frit bars, 120, 130, 140, and 150.

Additionally, electrically conductive traces (not shown) extend through the thin strip area 160 to allow for connectivity to row and column electrodes in the active area 110. A passivation layer, for example, composed of silicon nitride ($Si_xN_y$) can be deposited over the electrically conductive traces for protecting the electrodes from damage and contamination during the sealing process.

Prior art flat panel displays include a thin glass faceplate having one or more layers of phosphor deposited over the interior surface thereof. The faceplate is typically separated from the backplate by about 0.1 to 5 millimeters. The faceplate includes an active area within which the layer (or layers) of phosphor is deposited. A thin strip that does not contain phosphor extends from the active area to the edges of the glass plate. The faceplate is attached to the backplate using a glass seal.

In one prior art process, glass frit bars (e.g., frit bars 120, 130, 140, and 150), or bars with a thin layer of frit material, are placed within the thin strip in a frame-shape such that the glass frit bars surround the active area of the faceplate. The backplate is then placed over the faceplate. The flat panel display assembly is then aligned and may be tacked so as to hold the faceplate and the backplate in their proper alignment. Typically, four tacks are used: one in each corner of the flat panel display assembly, for example. The thickness of the frit bars is less than the distance between the faceplate and the backplate such that there is a gap between the top of the glass frit and the bottom of the faceplate. This gap is typically about one to two thousandths of an inch.

The assembly is then placed in an oven and heated to the bias temperature of the glass frit bars (this is done to minimize stress fracturing resulting from the sudden increase in temperature). A laser is then used to melt the glass frit bars. The heat of the laser melts the glass frit locally and causes the glass frit to expand such that the glass frit contacts the backplate, thereby wetting the surface of the backplate and forming a "bead." The laser is moved, drawing the bead around the surface of the glass frit until the desired seal is formed.

Also, an oven sealing process can be used rather than a laser for melting the glass frit and forming the desired seal between the backplate and the faceplate.

The melting of the glass frit forms an enclosure that is subsequently evacuated so as to produce a vacuum between the active area of the backplate and the active area of the faceplate. In operation, individual regions of the cathode are selectively activated to generate electrons which strike the phosphor so as to generate a display within the active area of the faceplate. These flat panel displays have all of the advantages of conventional CRT displays but are much thinner.

Prior art flat panel display fabrication processes often result in a defective seal between the faceplate and the backplate, such as the backplate shown in Prior Art FIG. 1B. Defective seals result from outgas species that condense on the metal electrodes. This condensation creates an unwettable surface when sealing the frontplate to the backplate with the glass frit bars. As such, leakage of the vacuumed enclosure between the faceplate and the backplate can occur rendering the display device unusable or defective. In other cases, the frit material can dissolve the row and column electrodes.

In particular, Prior Art FIG. 1B illustrates a side sectional view of the backplate 105 taken along a line X—X in FIG. 1A. As shown, nitrogen outgas species creates defections within the seal attaching faceplate 115 to backplate 105 that lead to porous leak paths 170 through the seal attaching the backplate 105 to the faceplate 115 of the flat panel display.

The nitrogen outgas species is a product of the spontaneous reaction between the frit bar 130 and the silicon nitride layer 180 along the line X—X as shown in Prior Art FIG. 1B. As discussed previously, the silicon nitride layer 180 is a passivation layer that protects electrodes and or their corresponding electrically conductive traces leading into the active area 110.

During the sealing process for attaching the faceplate 115 to the backplate 105, the reaction between the frit bar 130 and the silicon nitride layer 180 is most pronounced. Contained within the silicon nitride layer 180 is lead oxide. The lead oxide spontaneously reacts with silicon nitride ($Si_xN_y$) in the silicon nitride layer 180. The reaction as shown in equation (1) below, has a negative free energy value indicating the reaction is spontaneous at temperatures used for sealing the faceplate 115 to the backplate 105 of a field emission display device. As a result, nitrogen outgas species is readily produced leading to porous leak paths 170 and a degradation in the seal between the faceplate 115 and the backplate 105, particularly in the seal between the frit bar 130 and the silicon nitride layer 180.

$$Si_3N_4+6PbO \leftrightarrows 3SiO_2+6Pb+2N_2 \quad (1)$$

Most particularly, during an oven sealing process, the reaction as shown above in Equation (1) occurs over a greater period of time in relation to the laser sealing process. As such, more nitrogen outgas species is produced leading to more porous leaks 170 and greater degradation of the sealing between the faceplate and the backplate.

Additionally, the nitrogen outgas species bubbles to the surface of the silicon nitride layer 180 that is adjacent to the localized frit bar 130 as shown in Prior Art FIG. 1B. The bubbling of the nitrogen outgas species in the interface between the frit bar 130 and the silicon nitride layer 180 indicates poor wettability between the frit bar 130 and the silicon nitride layer 180. As such, degradation of the seal between the frit bar 130 and the silicon nitride layer 180 occurs.

Moreover, nitrogen gas is produced when depositing the silicon nitride passivation layer 180 over the electrically conductive traces leading to the row and column electrodes in the active region. The silicon nitride passivation layer 180 is deposited by a plasma enhanced chemical vaporization process (PE CVD). In the PE CVD process, hydrogen is produced which leads to production of nitrogen gas from the silicon nitride that is deposited. This nitrogen gas bubbles to the surface of the silicon nitride passivation layer and creates porous leaks (e.g., porous leaks 170) in the interface between the silicon nitride passivation layer 180 and the localized glass frit bar 130.

Thus, a need exists for a sealing frame process that results in lower leak rates. Another need exists for a sealing process that creates a more reliable seal between the backplate and the faceplate. Still another need exists for a sealing process that provides better wettability for the glass frit bar in sealing a faceplate to a backplate of a field emission display device.

SUMMARY OF THE INVENTION

The present invention provides a method for protecting the glass frit bar from reacting with a silicon nitride passivation layer when sealing a faceplate to a backplate on a field emission display device. Also, the present invention provides a method that achieves the above accomplishment and which also provides for a sealing frame process that results in lower leak rates. Additionally, the present invention provides a method that achieves the above accomplishments and which also provides for a sealing frame process that creates a more reliable seal between the faceplate and a backplate. Moreover, the present invention provides a method that achieves the above accomplishments and which also provides for better wettability for the glass frit bar in sealing the faceplate to a backplate of a field emission display device.

Specifically, one embodiment of the present invention discloses a method for attaching a faceplate and a backplate of a field emission display device. Specifically, a silicon nitride passivation layer is prevented from reacting with a glass frit sealing material during an oven sealing or laser sealing process. The silicon nitride passivation layer protects row and column electrodes in the display device. A barrier material fully encapsulates the silicon nitride passivation layer to prevent reaction with lead oxide present in the glass frit sealing material. In one embodiment, silicon dioxide is the barrier material. In another embodiment, spin-on-glass is the barrier material. In still another embodiment, cermet is the barrier material.

In one embodiment of the present invention, the method includes creating a cathode backplate structure that includes row and column electrodes. A silicon nitride passivation layer is deposited over electrical traces in the pad bond region that lead to the row and column electrodes in the active region of the cathode backplate structure. The pad bond region is the area used for attaching the cathode backplate structure to a faceplate in a field emission display device.

The silicon nitride passivation layer is then encapsulated with a barrier material. In one embodiment, the barrier material is silicon dioxide. In still another embodiment, the barrier material is spin-on-glass. In another embodiment, the barrier material is a cermet mixture of chromium oxide and quartz. In one embodiment the cermet mixture has an approximate composition of sixty-two percent chromium oxide ($Cr_2O_3$) and thirty-eight percent quartz ($SiO_2$).

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

PRIOR ART

PRIOR ART

DETAILED DESCRIPTION OF THE INVENTION

Reference will now be made in detail to the preferred embodiments of the present invention, a method for preventing reaction between a silicon nitride passivation layer and the glass frit sealing material when attaching a faceplate to a backplate of a flat panel display device, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

For purposes of the present Application, a method for preventing reaction between the silicon nitride passivation layer and a glass frit sealing material will be described in conjunction with being used to attach a faceplate of a flat panel display to a backplate of a flat panel display. Although such an embodiment is described herein, the method is also well suited to sealing any of various first surfaces to any of various second surfaces.

In addition, a method is described for attaching a faceplate of a flat panel display device to a backplate of a flat panel display device. A description for attaching a faceplate of a flat panel display device to a backplate of flat panel display device is described in Narayanan et al., U.S. Pat. No. 6,113,450, titled, SEAL MATERIAL FRIT FRAME FOR FLAT PANEL DISPLAYS, that is herein incorporated by reference as background material.

Accordingly, the present invention provides a method for protecting the glass frit bar from reacting with a silicon nitride passivation layer when sealing a faceplate to a backplate on a field emission display device. Also, the present invention provides a method that achieves the above accomplishment and which also provides for a sealing frame process that results in lower leak rates. Additionally, the present invention provides a method that achieves the above accomplishments and which also provides for a sealing frame process that creates a more reliable seal between the faceplate and a backplate. Moreover, the present invention provides a method that achieves the above accomplishments and which also provides for better wettability for the glass frit bar in sealing the faceplate to a backplate of a field emission display device.

Figure 1A:
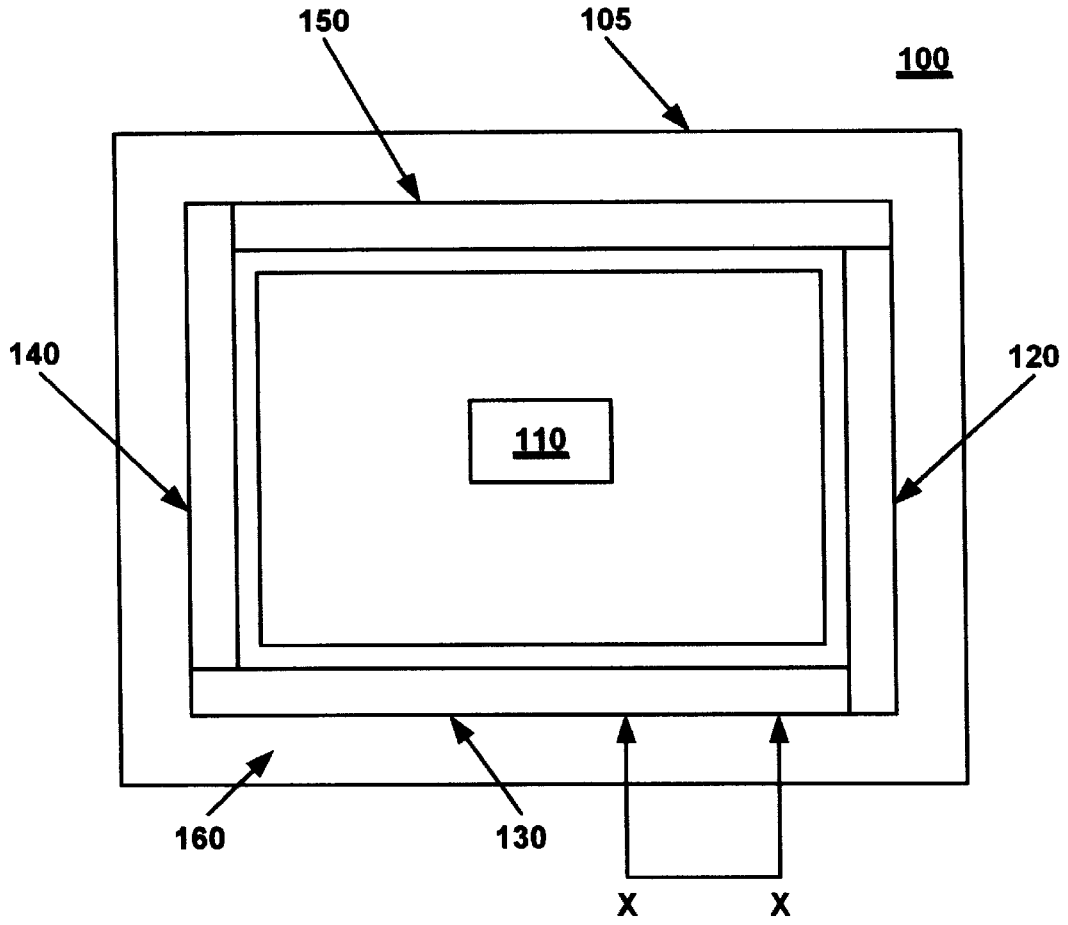
FIG. 1A (Prior Art)
FIG. 1A illustrates an cathode backplate structure of an exemplary field emission display device showing the pad bond region.
Figure 1B:
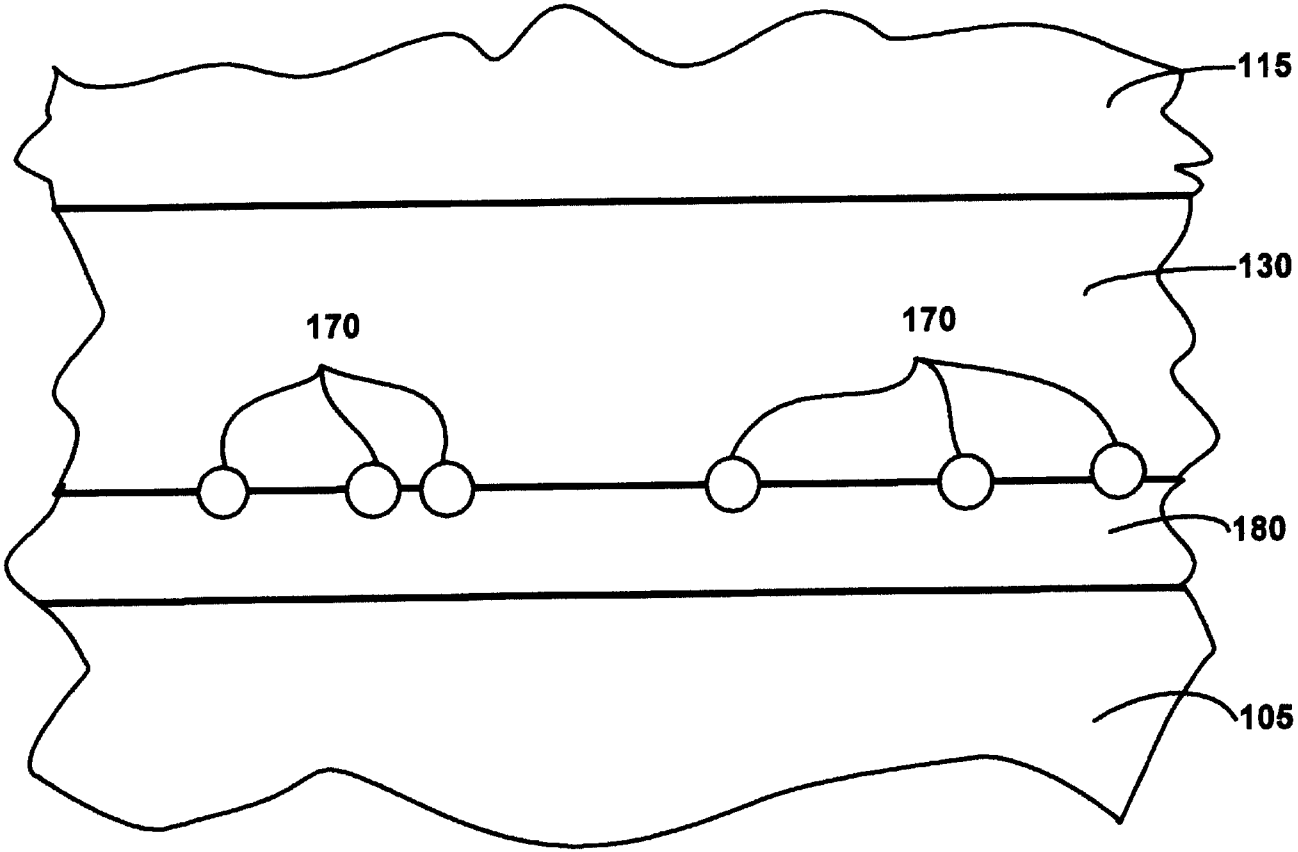
FIG. 1B (Prior Art)
FIG. 1B illustrates a side sectional view taken along the line X—X showing the leakage paths in the seal between the glass frit bar and the silicon nitride passivation layer.
Figure 2A:
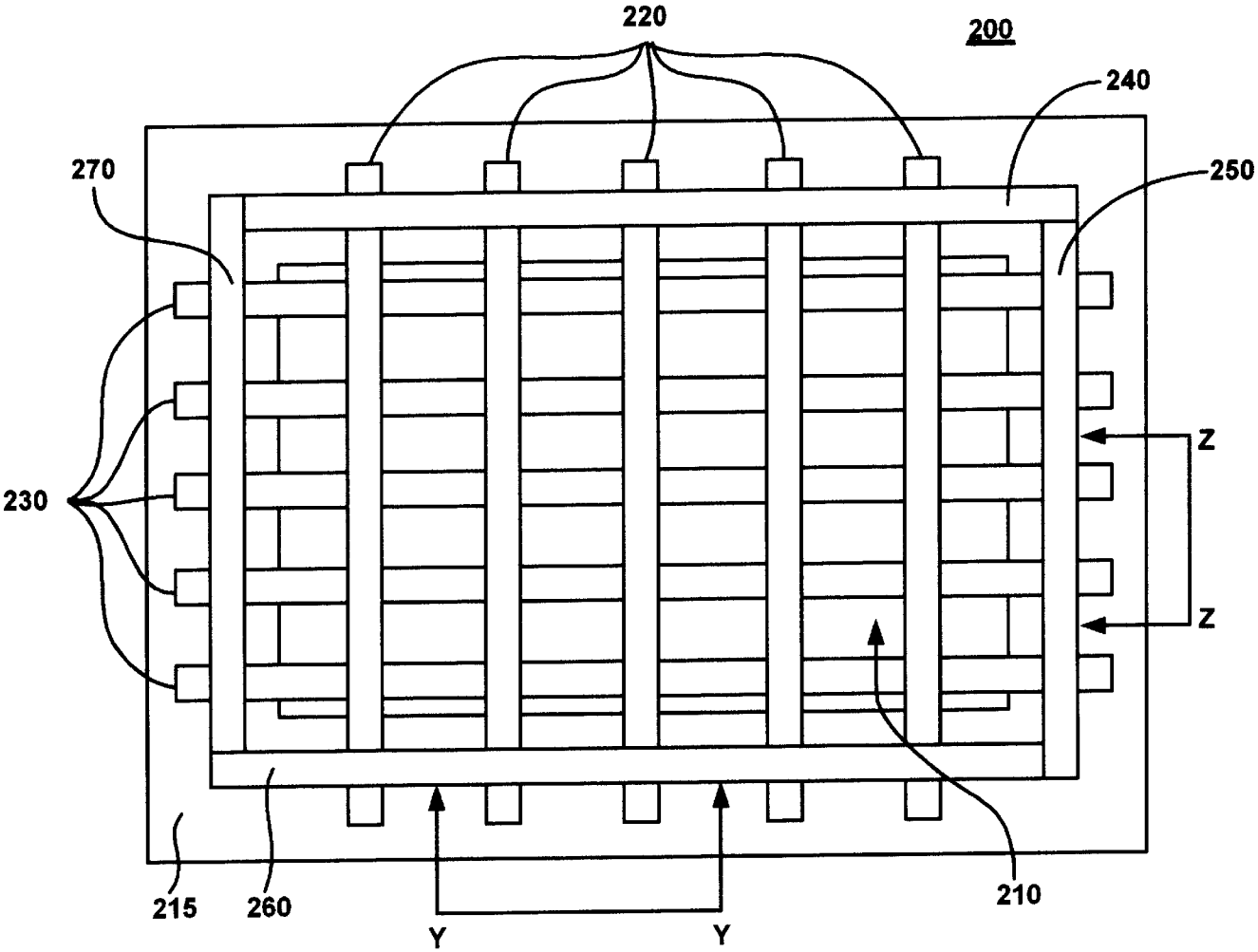
FIG. 2A illustrates a top view of an exemplary cathode backplate structure showing the glass frit bar sealing material covering the row and column electrodes in the pad bond region.

FIG. 2A illustrates a top view of an exemplary cathode backplate structure 200 for a flat panel display device, in accordance with one embodiment of the present invention. The backplate structure is representative of a cathode with row and column electrodes leading to electron emitters in the active area 210 of the cathode backplate structure 200. In addition, a pad bond region 215 is shown outside of the active area 210 that provides an area for bonding the cathode backplate to a faceplate of a field emission flat panel display device.

Row electrodes 230 are shown in the active area 210 and the pad bond region 215. In another embodiment, electrically conductive traces are attached to the ends of the row electrodes 230 in the pad bond region 215 and provide conduction paths to the row electrodes 230 in the active area 210. For purposes of clarity, FIG. 2A simply shows the row electrodes 230 extending from the active area 210 and into the pad bond region 215.

Column electrodes 220 are shown in the active area 210 and the pad bond region 215. Column electrodes can also be under the row electrodes 230. In another embodiment, electrically conductive traces are attached to the ends of the column electrodes 220 in the pad bond region 215 and provide conduction paths to the row electrodes 230 in the active area 210. For purposes of clarity, FIG. 2A simply shows the column electrodes 220 extending from the active area 210 and into the pad bond region 215.

Referring again to FIG. 2A, seal material bars are deposited around the active area of the backplate 200. In the embodiment shown in FIG. 2A, seal material bars 240, 250, 260, and 270 are deposited outside of the active area 210. The seal material bars 240, 250, 260, and 270 are deposited in the pad bond region 215 over the row electrodes 230 and the column electrodes 220. In one embodiment, the seal material bars are comprised of glass frit that includes lead oxide (PbO).

Figure 2B:
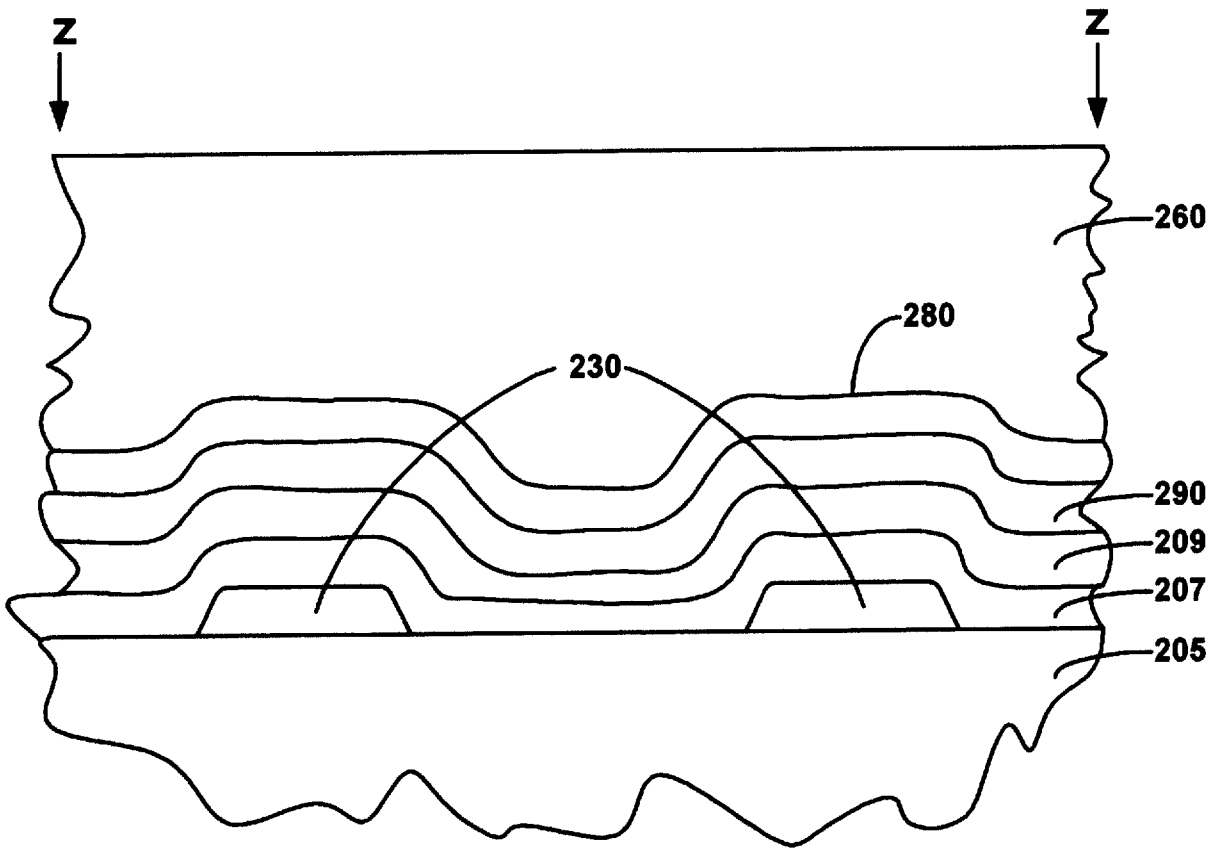
FIG. 2B illustrates a side sectional view of an exemplary cathode backplate structure showing a barrier material encapsulating the silicon nitride passivation layer over row electrodes.

Referring now to FIG. 2B, a side sectional view of the cathode backplate structure 200 in the pad bond region 215 taken along line Z—Z, as shown in FIG. 2A, is presented in accordance with one embodiment of the present invention. The cathode backplate structure 200 is formed on a glass plate 205.

In the present embodiment, row electrodes 230 are created directly on the surface of the glass plate 205. The process for creating the backplate structure 200 allows for the layering of different materials in succeeding steps for purposes of creating a flat panel display device. For example, a resistor layer 207 is shown to cover the glass plate 205 and the row electrodes 230.

Referring back to FIG. 2B, an inter-layer dielectric (ILD) layer 209 covers the resistor layer 207. The ILD layer 209 electrically isolates the row electrodes 230 from the column electrodes 220 in the cathode backplate structure 200.

The present embodiment as illustrated in FIG. 2B shows a passivation layer 290 composed of silicon nitride ($Si_xN_y$) that covers the column electrodes 230. The silicon nitride passivation layer 290 is deposited over the ILD layer 209. The passivation layer is necessary to protect the column electrodes 230 from contamination and degradation during the manufacturing and sealing processes used in attaching the faceplate to the backplate of the flat panel display device.

The present invention recites depositing a layer of a barrier material layer 280 over the silicon nitride passivation layer 290. The barrier material layer 280 fully encapsulates the silicon nitride passivation layer 290. As such, the silicon nitride passivation layer 290 is chemically isolated from reacting with the lead oxide present in the glass frit sealing material 260 that is deposited over the barrier material layer 280.

The barrier material layer 280 prevents the production of nitrogen gas should an interface exist between the glass frit 260 and the silicon nitride layer 290. In addition, the barrier material does not spontaneously react with either the glass frit material 260 or the silicon nitride layer 290. As such, leakage paths due to the nitrogen outgas species are eliminated when attaching the backplate structure 200 to a faceplate in a flat panel display device. FIG. 2B shows a continuous seal between each of the layers covering the glass plate 205 of the cathode backplate 200. In particular, the barrier material layer 280 creates a good and continuous seal between the glass frit 260 and the silicon nitride passivation layer 290.

The barrier material layer 280 creates a good and continuous seal when attaching the faceplate to the cathode backplate 200 of a flat panel display device. As a result, the nitrogen outgas species produced from the reaction of the lead oxide in the glass frit material 260 and the silicon nitride layer 290 is eliminated. Also, the leakage problems inherent in sealing processes that does not include a barrier material layer 280 are lessened and/or eliminated.

The side sectional view of FIG. 2B only shows two of the many column electrodes 230 that are formed on cathode backplate structure 200.

Figure 2C:
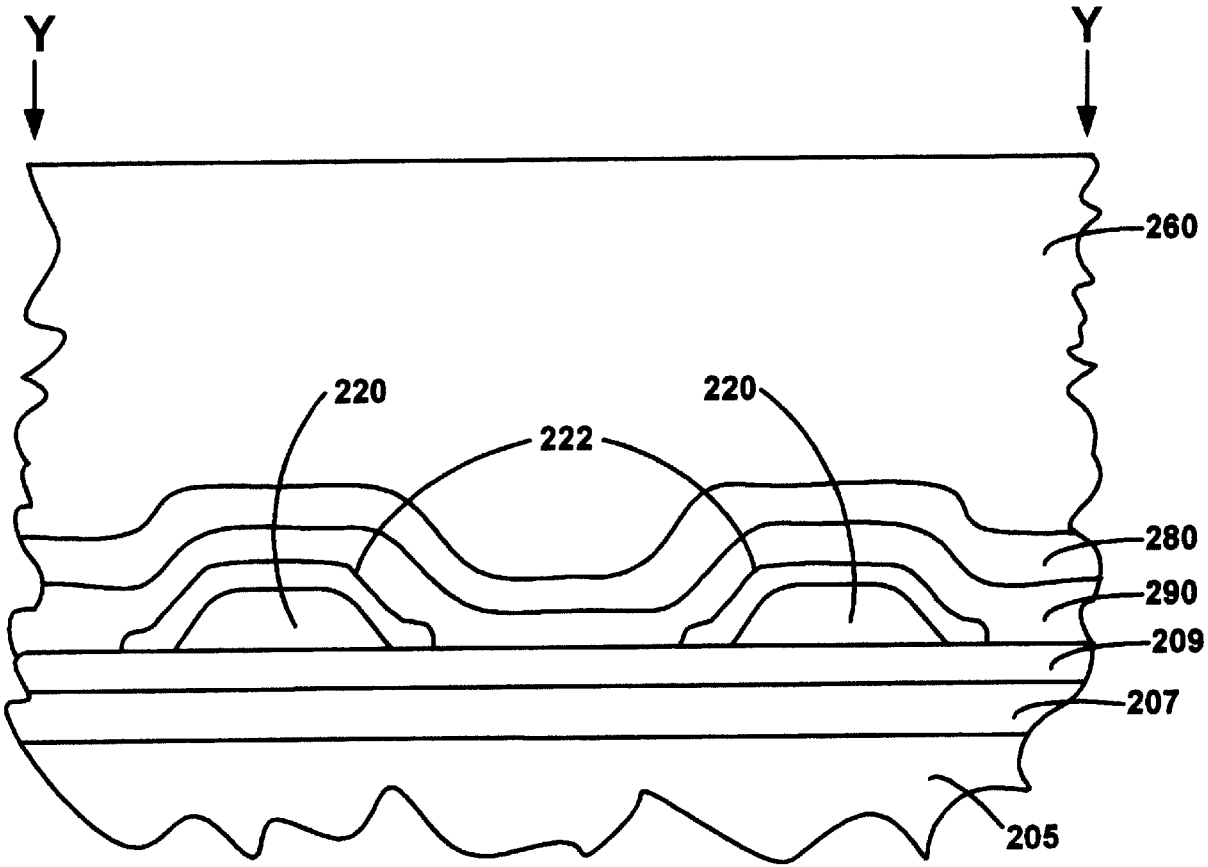
FIG. 2C illustrates a side sectional view of an exemplary cathode backplate structure showing a barrier material encapsulating the silicon nitride passivation layer over column electrodes.

FIG. 2C illustrates a side sectional view of the cathode backplate structure 200 in the pad bond region 215 taken along line Y—Y as shown in FIG. 2A, in accordance with one embodiment of the present invention. The cathode backplate structure 200 is formed on the glass plate 205. A resistor layer covers the glass plate 205. Also, the same an ILD layer 209 covers the resistor layer 207.

Referring back to FIG. 2C, column electrodes 220 are shown to be formed after the ILD layer 209 is deposited. As such, the ILD layer 209 electrically isolates the column electrodes 220 from the previously created row electrodes 230. The side sectional view of FIG. 2C only shows two of the many column electrodes 220 that are formed on cathode backplate structure 200. A gate metal material 222 is deposited over each of the column electrodes 220.

The present embodiment as illustrated in FIG. 2C shows the passivation layer 290 composed of silicon nitride ($Si_xN_y$) that covers the column electrodes 220. The silicon nitride passivation layer 290 in one embodiment is deposited after both the row electrodes 230 and the column electrodes 220 are created. The passivation layer is necessary to protect the column electrodes 220 from contamination and degradation during the manufacturing and sealing processes used in attaching the faceplate to the backplate 200 of the flat panel display device.

The present embodiment recites depositing the layer 280 of a barrier material over the silicon nitride passivation layer 290. The barrier material layer 280 fully encapsulates the silicon nitride passivation layer 290. As such, the silicon nitride passivation layer 290 is chemically isolated from reacting with the lead oxide contained within the glass frit sealing material 260 that is deposited over the barrier material layer 280.

In one embodiment of the present invention, the barrier material is composed of silicon dioxide ($SiO_2$). The silicon dioxide encapsulates the silicon nitride layer 290 as shown in FIGS. 2B and 2C. The silicon dioxide is deposited using typical processes with a thickness of less than 2000 Angstroms.

The silicon dioxide layer prevents the reaction between the lead oxide in the glass frit material 260 and the silicon nitride passivation layer 290. In addition, silicon dioxide provides for better wettability for the glass frit material 260 for bonding purposes than the silicon nitride layer 290. This, in turn, leads to a more reliable sealing process used for attaching a cathode backplate 200 to a faceplate of a flat panel display device, such as a field emission display device.

In another embodiment of the present invention, the barrier material is composed of spin-on-glass (SOG). The SOG encapsulates the silicon nitride layer 290 as shown in FIGS. 2B and 2C. The SOG is deposited using typical processes with a thickness of less than 2000 Angstroms.

The SOG layer prevents the reaction between the lead oxide in the glass frit material 260 and the silicon nitride passivation layer 290. In addition, SOG provides for better wettability for the glass frit material 260 for bonding purposes than the silicon nitride layer 290. This, in turn, leads to a more reliable sealing process used for attaching a cathode backplate 200 to a faceplate of a flat panel display device, such as a field emission display device.

In still another embodiment of the present invention, the barrier material is composed of cermet ($SiCr_xO_y$). The cermet coating consists of chromium oxide ($Cr_2O_3$) and quartz ($SiO_2$) In one embodiment, the concentrations of the cermet coating is approximately sixty-two percent chromium oxide and thirty-eight percent quartz. The cermet coating fully encapsulates the silicon nitride layer 290 as shown in FIGS. 2B and 2C. The cermet coating is deposited using typical processes with a thickness of approximately 500 Angstroms.

The cermet coating prevents the reaction between the lead oxide in the glass frit material 260 and the silicon nitride passivation layer 290. In addition, cermet provides for better wettability for the glass frit material 260 for bonding purposes than the silicon nitride layer 290. This, in turn, leads to a more reliable sealing process used for attaching a cathode backplate 200 to a faceplate of a flat panel display device, such as a field emission display device.

The FIGS. 2A, 2B, and 2C are exemplary only and it is understood that creation of cathode backplate structure can include row over column electrodes and column over row electrodes.

Figure 3:
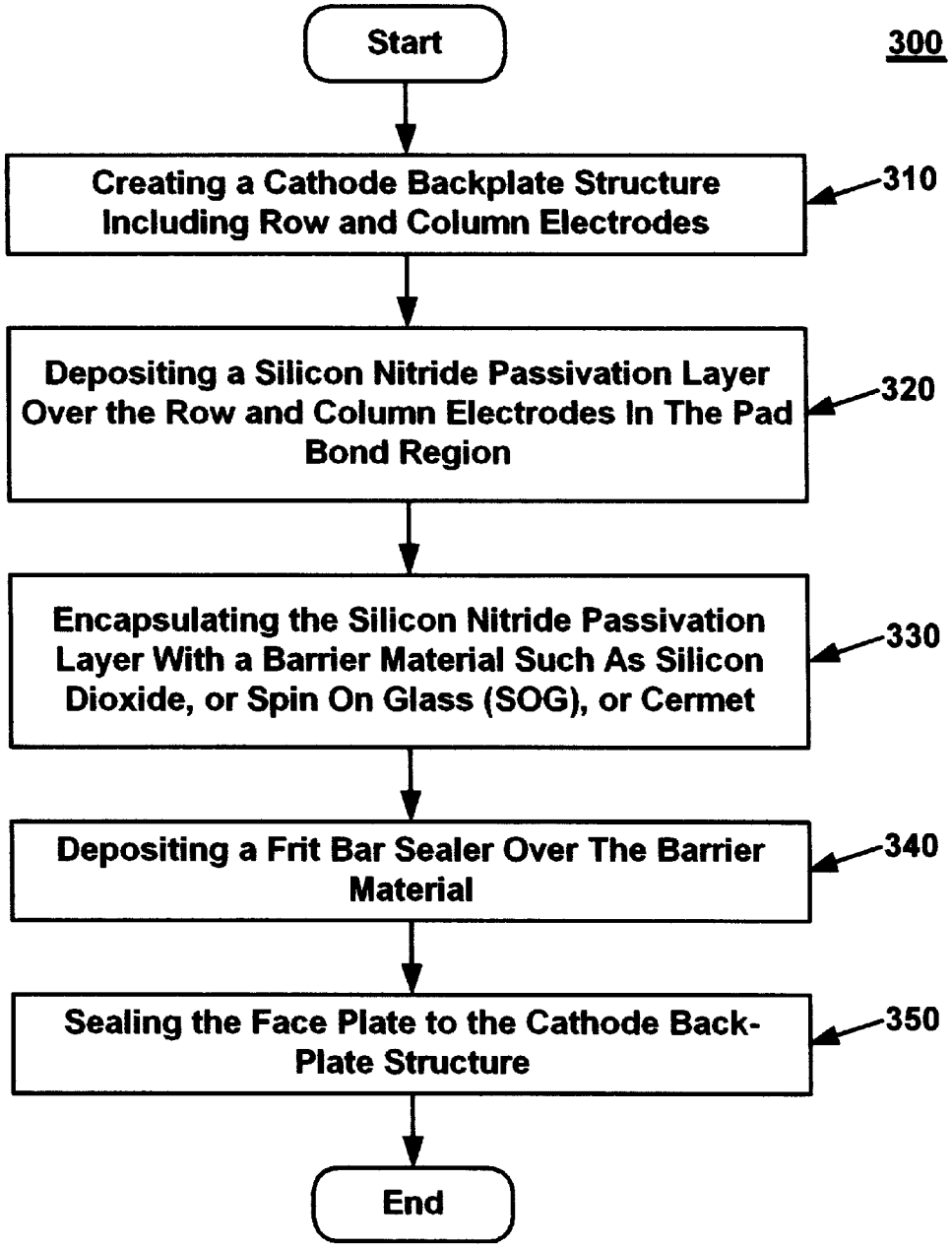
FIG. 3 is a flow diagram illustrating steps in a method for preventing the glass frit bar from reacting with the silicon nitride passivation layer when sealing a backplate to a faceplate of a field emission display device.

FIG. 3 illustrates an exemplary flow chart 300 for preventing reaction between the glass frit sealing material and the silicon nitride passivation layer when attaching a cathode backplate to a faceplate of a flat panel display device, in accordance with one embodiment of the present invention.

In step 310, the present embodiment creates a cathode backplate structure that includes row and column electrodes. The row and column electrodes extend from the active area of the cathode backplate into a pad bond region of the cathode backplate. In another embodiment, electrical traces in the pad bond region electrically couple to the row and column electrodes in the active area.

In step 320, the present embodiment deposits a silicon nitride passivation layer over the row and column electrodes in the pad bond region. The passivation layer is used to protect the row and column electrodes from contamination, attack, and degradation during the sealing process used to attach the backplate to the faceplate of a flat panel display device.

In step 330, the present embodiment fully encapsulates the silicon nitride passivation layer with a barrier material. In one embodiment, the barrier material is silicon dioxide. In another embodiment, the barrier material is spin-on-glass (SOG). In still another embodiment, the barrier material is cermet ($SiCr_xO_y$). The cermet can be composed of chromium oxide and quartz.

In step 340, the present embodiment deposits a frit bar sealing material over the barrier material. The frit bar sealing material is used for attaching the faceplate to a cathode backplate of a flat panel display device.

In step 350, the present embodiment seals the faceplate to the cathode backplate structure of the flat panel display device with the glass frit sealing material. Typical sealing processes used are oven sealing and laser sealing processes. The method described in the present embodiment works independently of the sealing process used and can be used for both the oven sealing and laser sealing processes.

While the methods of embodiments illustrated in flow chart 300 show specific sequences and quantity of steps, the present invention is suitable to alternative embodiments. For example, not all the steps provided for in the method are required for the present invention. Furthermore, additional steps can be added to the steps presented in the present embodiment. Likewise, the sequences of steps can be modified depending upon the application.

A method for preventing a glass frit sealing material from reacting with the silicon nitride passivation layer when attaching a faceplate to a cathode backplate of a field emission flat panel display device, is thus described. While the present invention has been described in particular embodiments, it should be appreciated that the present invention should not be construed as limited by such embodiments, but rather construed according to the below claims.

What is claimed is:

1. A method for attaching a first surface to a second surface, said method comprising the steps of:

a) depositing a passivation layer over electrodes in a pad bond region of said first surface;

b) encapsulating said passivation layer with a barrier material;

c) depositing a sealing material between said first surface and said second surface; and d) subjecting said sealing material to a sealing process in order to attach said first surface to said second surface.

2. The method as described in claim 1, wherein said step a) further comprises the step of:

depositing a silicon nitride passivation layer.

3. The method as described in claim 1, wherein said step a) further comprises the step of:

depositing a passivation layer over row and column electrodes.

4. The method as described in claim 1, wherein said step b) further comprises:

encapsulating said passivation layer with silicon dioxide.

5. The method as described in claim 1, wherein said step b) further comprises:

encapsulating said passivation layer with spin-on-glass (SOG).

6. The method as described in claim 1, wherein said step b) further comprises:

encapsulating said passivation layer with cermet ($SiCr_xO_y$) that includes silicon, chromium, and oxygen.

7. The method as described in claim 6, wherein said step b) further comprises:

encapsulating said passivation layer with cermet that includes sixty-two percent chromium oxide ($Cr_2O_3$) and thirty-eight percent quartz ($SiO_2$).

8. The method as described in claim 1, wherein said step d) further comprises:

subjecting said sealing material to a laser sealing process.

9. The method as described in claim 1, wherein said step d) further comprises:

subjecting said sealing material to an oven sealing process.

10. The method as described in claim 1, wherein said first surface is a backplate of a field emission display device.

11. The method as described in claim 1, wherein said second surface is faceplate of a field emission display device.

12. The method as described in claim 1, wherein said step c) further comprises;

depositing a glass frit sealing material that includes lead oxide.

13. The method as described in claim 1, comprising the further step of:

applying said barrier material over said passivation layer as part of an inner metal dielectric layer for purposes of encapsulating said passivation layer.

14. The method as described in claim 1, comprising the further step of:

depositing said barrier material over said passivation layer for purposes of encapsulating said passivation layer.

15. A method for attaching a first surface to a second surface, said method comprising the steps of:

a) depositing a silicon nitride passivation layer over electrodes in a pad bond region of said first surface;

b) encapsulating said silicon nitride passivation layer with a barrier material;

c) depositing a glass frit sealing material between said first surface and said second surface, said glass frit sealing material including lead oxide; and d) subjecting said glass frit sealing material to a sealing process in order to attach said first surface to said second surface.

16. The method as described in claim 15, wherein said step a) further comprises the step of:

depositing said silicon nitride passivation layer over row and column electrodes.

17. The method as described in claim 15, wherein said barrier material is taken from a group consisting essentially of:

silicon dioxide;

spin-on-glass; and cermet ($SiCr_xO_y$).

18. The method as described in claim 17, wherein said cermet that includes sixty-two percent chromium oxide ($Cr_2O_3$) and thirty-eight percent quartz ($SiO_2$).

19. The method as described in claim 15, wherein said step d) further comprises:

subjecting said glass frit sealing material to a laser sealing process.

20. The method as described in claim 15, wherein said step d) further comprises:

subjecting said glass frit sealing material to an oven sealing process.

21. The method as described in claim 15, wherein said first surface is a backplate of a field emission display device.

22. The method as described in claim 15, wherein said second surface is faceplate of a field emission display device.

* * * * *

UNITED STATES PATENT AND TRADEMARK OFFICE
Certificate

Patent No. 6,565,400 B1 Patented: May 20, 2003

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Jueng-Gil Lee, Cupertino, CA (US); Paul N. Ludwig, Livermore, CA (US); Melissa Skocypec, Gilbert, AZ (US); Hidenori Kenmotsu, Tokyo (JP); and Shinji Kanagawa, Tokyo (JP).

Signed and Sealed this Twenty-fourth Day of September 2013.

NIMESHKUMAR D. PATEL
*Supervisory Patent Examiner*
Art Unit 2879
Technology Center 2800